US011682515B2

(12) United States Patent
Huang et al.

(10) Patent No.: US 11,682,515 B2
(45) **Date of Patent: *Jun. 20, 2023**

(54) INDUCTORS WITH MAGNETIC CORE PARTS OF DIFFERENT MATERIALS

(71) Applicant: MONOLITHIC POWER SYSTEMS, INC., San Jose, CA (US)

(72) Inventors: Dawson Huang, Santa Clara, CA (US); Ting Ge, San Jose, CA (US)

(73) Assignee: Monolithic Power Systems, Inc., San Jose, CA (US)

( * ) Notice: Subject to any disclaimer, the term of this patent is extended or adjusted under 35 U.S.C. 154(b) by 297 days.

This patent is subject to a terminal disclaimer.

(21) Appl. No.: 16/849,152

(22) Filed: Apr. 15, 2020

(65) Prior Publication Data

US 2021/0327628 A1 Oct. 21, 2021

(51) Int. Cl.

| | |
|---|---|
| ***H01F 17/04*** | (2006.01) |
| ***H01F 3/06*** | (2006.01) |
| ***H01F 3/10*** | (2006.01) |
| ***H01F 17/06*** | (2006.01) |

(52) U.S. Cl.

CPC ..... *H01F 17/043* (2013.01); *H01F 3/06* (2013.01); *H01F 3/10* (2013.01); *H01F 17/062* (2013.01); *H01F 2017/067* (2013.01)

(58) Field of Classification Search

CPC . H01F 17/043; H01F 3/06; H01F 3/10; H01F 17/062; H01F 2017/067; H01F 17/045; H01F 17/06; H01F 38/023; H01F 2003/106; H01F 27/24; H01F 1/0306; H01F 1/0315; H01F 27/255; H01F 27/306; H01F 38/14

See application file for complete search history.

(56) References Cited

U.S. PATENT DOCUMENTS

| | | | | |
|---|---|---|---|---|
| 6,362,986 | B1 | 3/2002 | Schultz et al. | |
| 6,774,758 | B2 * | 8/2004 | Gokhale | H02M 1/126 336/215 |
| 7,352,269 | B2 | 4/2008 | Li et al. | |
| 7,525,408 | B1 | 4/2009 | Li et al. | |
| 7,772,955 | B1 | 8/2010 | Li et al. | |
| 9,251,944 | B2 | 2/2016 | Hsieh et al. | |
| 2008/0303624 | A1 * | 12/2008 | Yamada | H01F 17/043 336/212 |
| 2010/0109826 | A1 * | 5/2010 | Sano | H01F 17/06 336/83 |
| 2014/0015508 | A1 | 1/2014 | Liang | |
| 2014/0055226 | A1 * | 2/2014 | Hsieh | H01F 3/14 336/212 |

FOREIGN PATENT DOCUMENTS

| | | | | |
|---|---|---|---|---|
| KR | 20130015580 A | * | 2/2016 | |
| WO | WO-0171712 A1 | * | 9/2001 | G11B 11/10534 |

* cited by examiner

*Primary Examiner* — Tuyen T Nguyen

(74) *Attorney, Agent, or Firm* — Beyer Law Group LLP

(57) ABSTRACT

An inductor has one or more wires and a multipart magnetic core. The multipart magnetic core has magnetic core parts that are adjacent and magnetically coupled. The inductor provides an inductance of at least 40 nH for currents greater than 1 A and less than 60 A, and at least 20 nH for currents of at least 60 A.

14 Claims, 18 Drawing Sheets

INDUCTORS WITH MAGNETIC CORE PARTS OF DIFFERENT MATERIALS

BACKGROUND OF THE INVENTION

1. Field of the Invention

The present invention relates generally to electrical components, and more particularly but not exclusively to inductors.

2. Description of the Background Art

Inductors are widely employed in various electrical circuits, such as filters and power converters. As a particular example, in a power converter, a single output inductor may be used to couple a switch node to an output node of the power converter. A coupled inductor may also be used to couple together the output phases of a multiphase power converter. The design of an electrical circuit is typically constrained by characteristics of components available to the designer. In terms of inductors, the designer selects an inductor available from a catalog of an electrical component vendor and makes design tradeoffs based on the characteristics of the inductor. The design tradeoffs involve compromises that hinder the performance of the electrical circuit.

SUMMARY

In one embodiment, an inductor comprises a multipart magnetic core and one or more wires. The multipart magnetic core may comprise a plurality of magnetic core parts. First and second magnetic core parts of the plurality of magnetic core parts may be disposed adjacent and magnetically coupled together to form one or more channels through which the one or more of wires may wind. The inductor provides an inductance of at least 40 nH for currents greater than 1 A and less than 60 A, and at least 20 nH for currents of at least 60 A.

The magnetic core parts may have a rectangular, toroidal, cylindrical, planar, or some other shape. The magnetic core parts may be symmetrical or asymmetrical. The inductor may be a single inductor with only one wire, or a coupled inductor with two or more wires.

The magnetic core parts may have the same material or different materials. The first magnetic core part may comprise a first magnetic material and the second magnetic core part may comprise a second magnetic material, with the first magnetic material having a steeper saturation slope and higher permeability than the second magnetic material.

These and other features of the present invention will be readily apparent to persons of ordinary skill in the art upon reading the entirety of this disclosure, which includes the accompanying drawings and claims.

The figures are not drawn to scale.

DETAILED DESCRIPTION

In the present disclosure, numerous specific details are provided, such as examples of electrical circuits and components, to provide a thorough understanding of embodiments of the invention. Persons of ordinary skill in the art will recognize, however, that the invention can be practiced without one or more of the specific details. In other instances, well-known details are not shown or described to avoid obscuring aspects of the invention.

Figure 1:
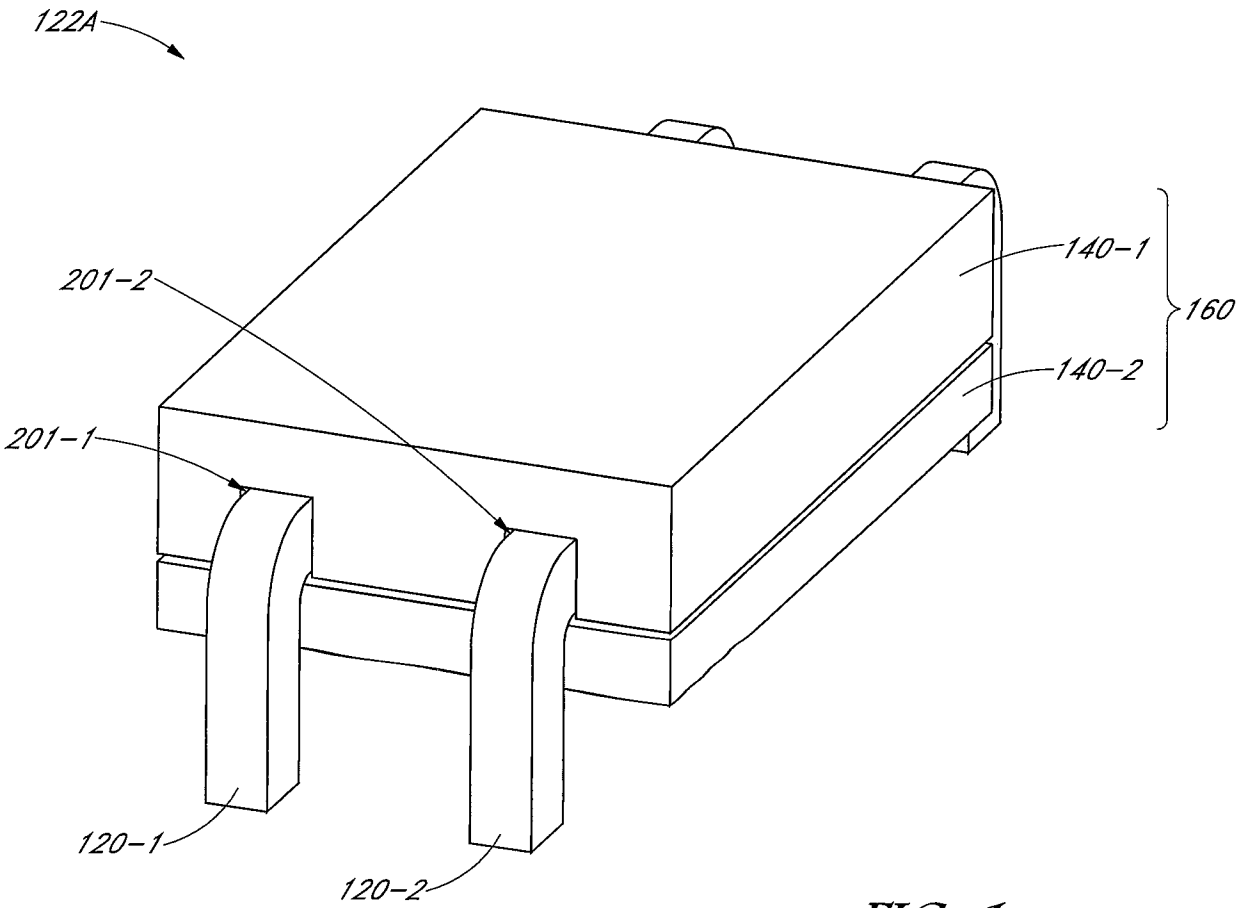
FIG. 1 is a three-dimensional view of an inductor with asymmetrical magnetic core parts in accordance with an embodiment of the present invention.

FIG. 1 is a three-dimensional view of an inductor 122A in accordance with an embodiment of the present invention. In the example of FIG. 1, the inductor 122A comprises a wire 120-1, a wire 120-2, and a multipart magnetic core 160. As its name indicates, the multipart magnetic core 160 comprises two or more magnetic core parts. In the inductor 122A, the multipart magnetic core 160 comprises a magnetic core part 140-1 and a magnetic core part 140-2.

The inductor 122A may be a coupled inductor or two inductors that are integrated together in one package. The inductor 122A is depicted in FIG. 1 with two wires 120-1, 120-2. Generally, a coupled inductor or two inductors that are integrated together in one package, such as the inductor 122A, comprise two or more wires. Each wire may have a first end that is coupled to a node of an electrical circuit, and an opposing second end that is coupled to another node the electrical circuit. For example, a first end of the wire 120-1

(e.g., see FIG. 21, end 141) may be electrically connected to a switch node of a power converter and a second end of the wire 120-1 (e.g., see FIG. 21, end 142) may be electrically connected to an output node of the power converter. In that example, a first end of the wire 120-2 (e.g., see FIG. 21, end 143) may be electrically connected to another switch node of the power converter and a second end of the wire 120-2 (e.g., see FIG. 21, end 144) may be electrically connected to the output node of the power converter.

The multipart magnetic core 160 is depicted in FIG. 1 with two magnetic core parts 140-1, 140-2. Generally, a multipart magnetic core in the present disclosure, such as the multipart magnetic core 160, comprises two or more physically separate magnetic core parts. The magnetic core parts are disposed adjacent and magnetically coupled to one another. Magnetic core parts may have metal-to-metal contact, i.e., the surfaces of adjacent magnetic core parts may directly touch. Paper, air, magnetic material, non-magnetic material, or other medium may also be inserted between adjacent magnetic core parts depending on the design specification of the inductor. A magnetic core part may comprise a ferromagnetic metal (e.g., iron), ferrimagnetic compounds (e.g., ferrites), iron powder (e.g., carbonyl powders), or another magnetic material. The magnetic core parts may comprise the same magnetic material or different magnetic materials.

In the example of FIG. 1, the magnetic core parts 140-1 and 140-2 are adjacent and magnetically coupled together to form a channel 201-1 for accepting the wire 120-1 and a channel 201-2 for accepting the wire 120-2. Each of the channels 201-1 and 201-2 provides a separate passageway through which a corresponding wire winds. In the inductor 122A, the magnetic core parts 140-1 and 140-2 each provides corresponding upper and lower portions of a passageway.

Figure 2:
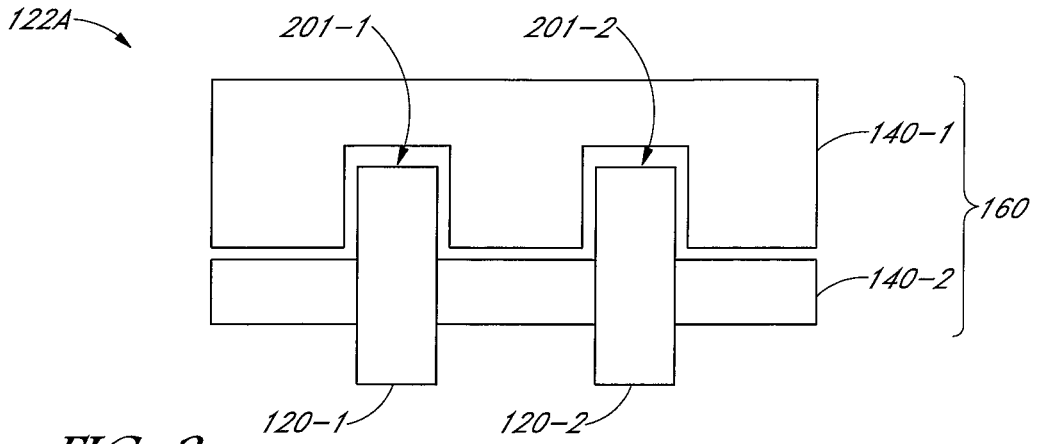
FIGS. 2-4 are various views of the inductor of FIG. 1.

FIG. 2 is a front view of the inductor 122A in accordance with an embodiment of the present invention. In the inductor 122A, the magnetic core part 140-1 has an E-shape and the magnetic core part 140-2 has a planar shape. The E-shape of the magnetic core part 140-1 has two trenches that when covered by a planar surface of the magnetic core part 140-2 form the channels 201-1 and 201-2.

Figure 3:
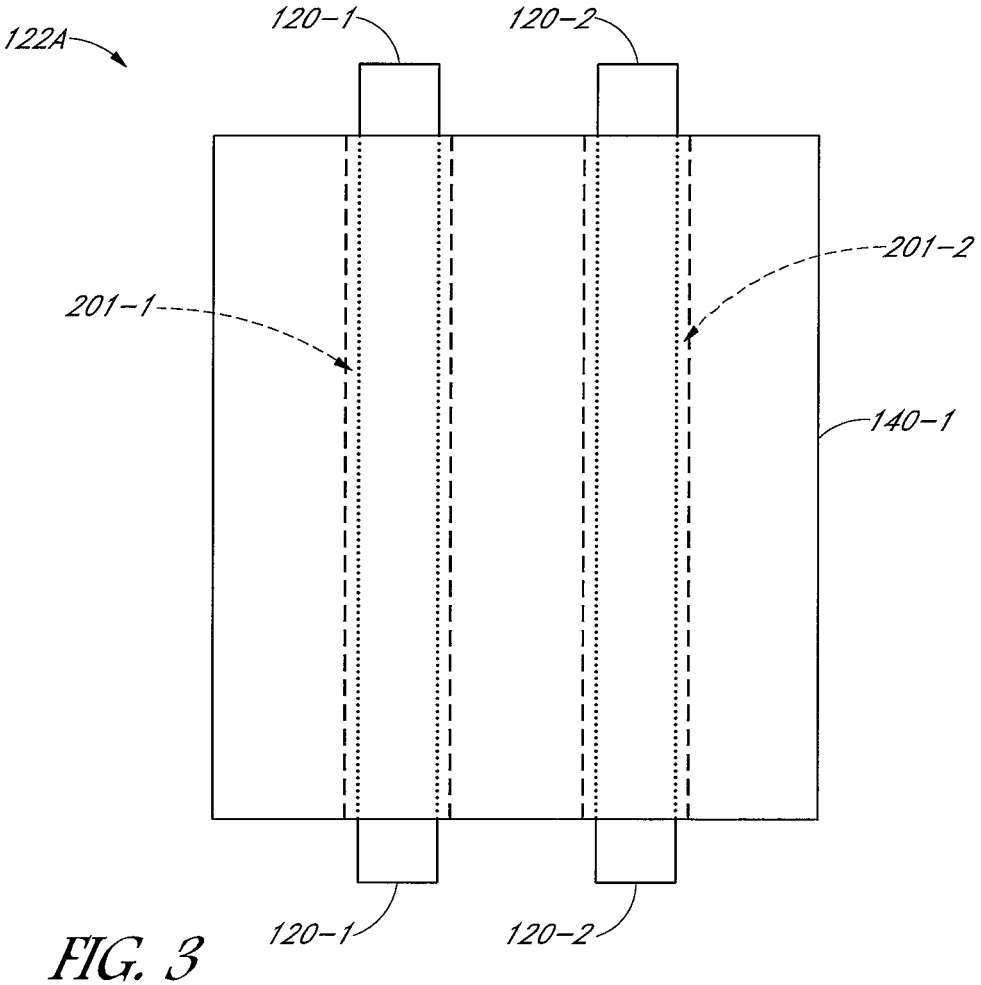

FIG. 3 is a top view of the inductor 122A as seen looking at the magnetic core part 140-1, in accordance with an embodiment of the present invention. As depicted by dashed lines, the channels 201-1 and 201-2 longitudinally extend front to back of the multipart magnetic core 160. The wires 120-1 and 120-2, which are depicted as dotted lines, go through the channels 201-1 and 201-2, respectively.

Figure 4:
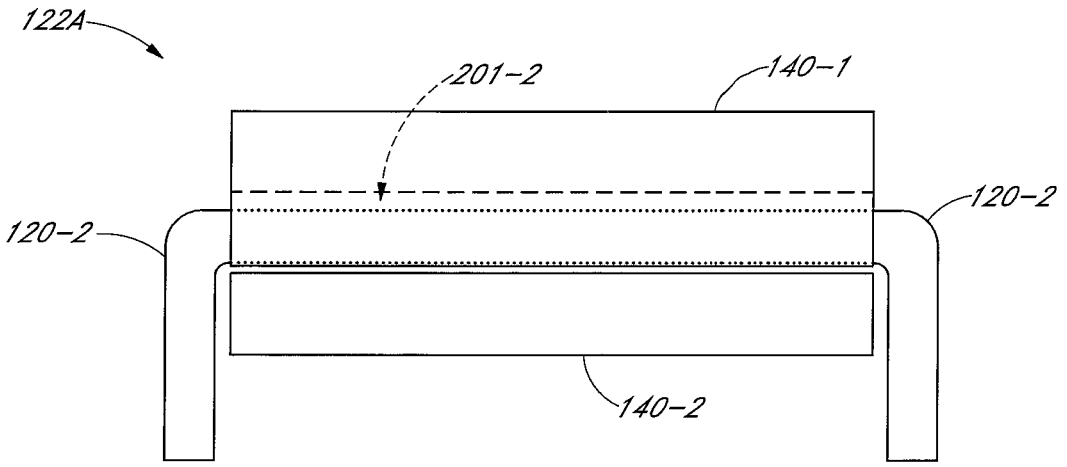

FIG. 4 is a side view of the inductor 122A as seen looking at the wire 120-2, in accordance with an embodiment of the present invention. In the example of FIG. 4, the wire 120-1 (on the other side) and the wire 120-2 extend downward upon exit from the multipart magnetic core 160. In that configuration, the wires 120-2 and 120-1 may extend down onto a via, pad, or other node of a printed circuit board (not shown) or other substrate. As can be appreciated, the wires 120-1 and 120-2 may also extend longitudinally outside of the multipart magnetic core 160 or have some other configuration.

In one embodiment, the wires 120-1 and 120-2 are single-turn wires. That is, in that embodiment, each of the wires 120-1 and 120-2 winds through the multipart magnetic core 160 only once. Generally, a wire may be wound through a multipart magnetic core one or more times depending on the design specification of the inductor. A wire may be wound on any of the magnetic core parts. For example, in the inductor 122A, each of the wires 120-1 and 120-2 may be wound on at least one of the magnetic core parts 140-1 and 140-2.

Figure 5:
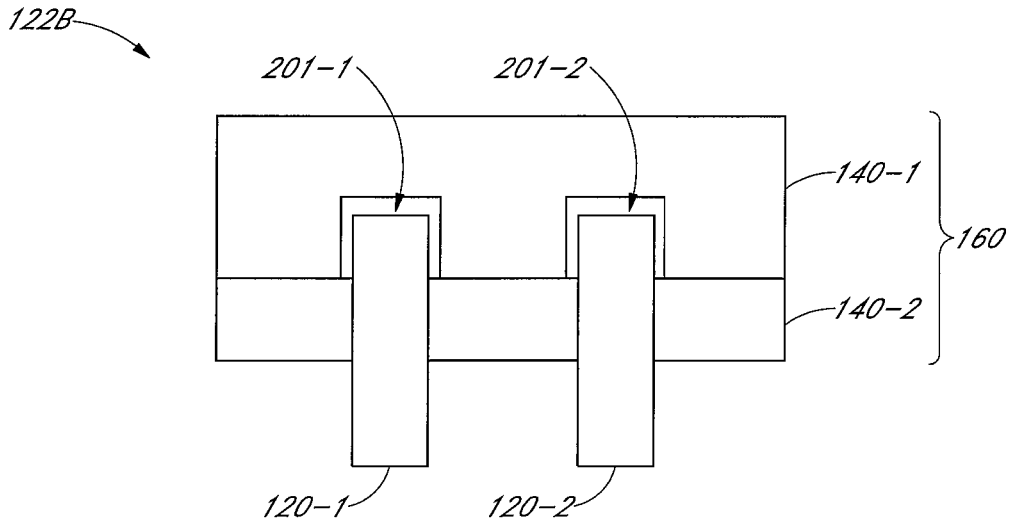
FIG. 5 is a front view of an inductor with metal-to-metal contact between adjacent magnetic core parts in accordance with an embodiment of the present invention.

In the inductor 122A, the magnetic core 140-1 is disposed adjacent and magnetically coupled to the magnetic core 140-2. The inductor 122A and other inductors in the present disclosure are depicted with a space between adjacent magnetic core parts for clarity of illustration. However, the magnetic core parts may also be directly in contact, as illustrated in the front view of an inductor 122B shown in FIG. 5. In the inductor 122B, a bottom surface of the magnetic core part 140-1 is depicted as making a metal-to-metal contact with a top surface of the magnetic core part 140-2. The inductor 122B is otherwise the same the inductor 122A.

A multipart magnetic core may have more than two magnetic core parts. For example, the magnetic core part 140-1 may comprise multiple, smaller magnetic core parts that together form the magnetic core part 140-1. As another example, additional magnetic core parts may be added to the multipart magnetic core 160 as now described with reference to FIG. 6.

Figure 6:
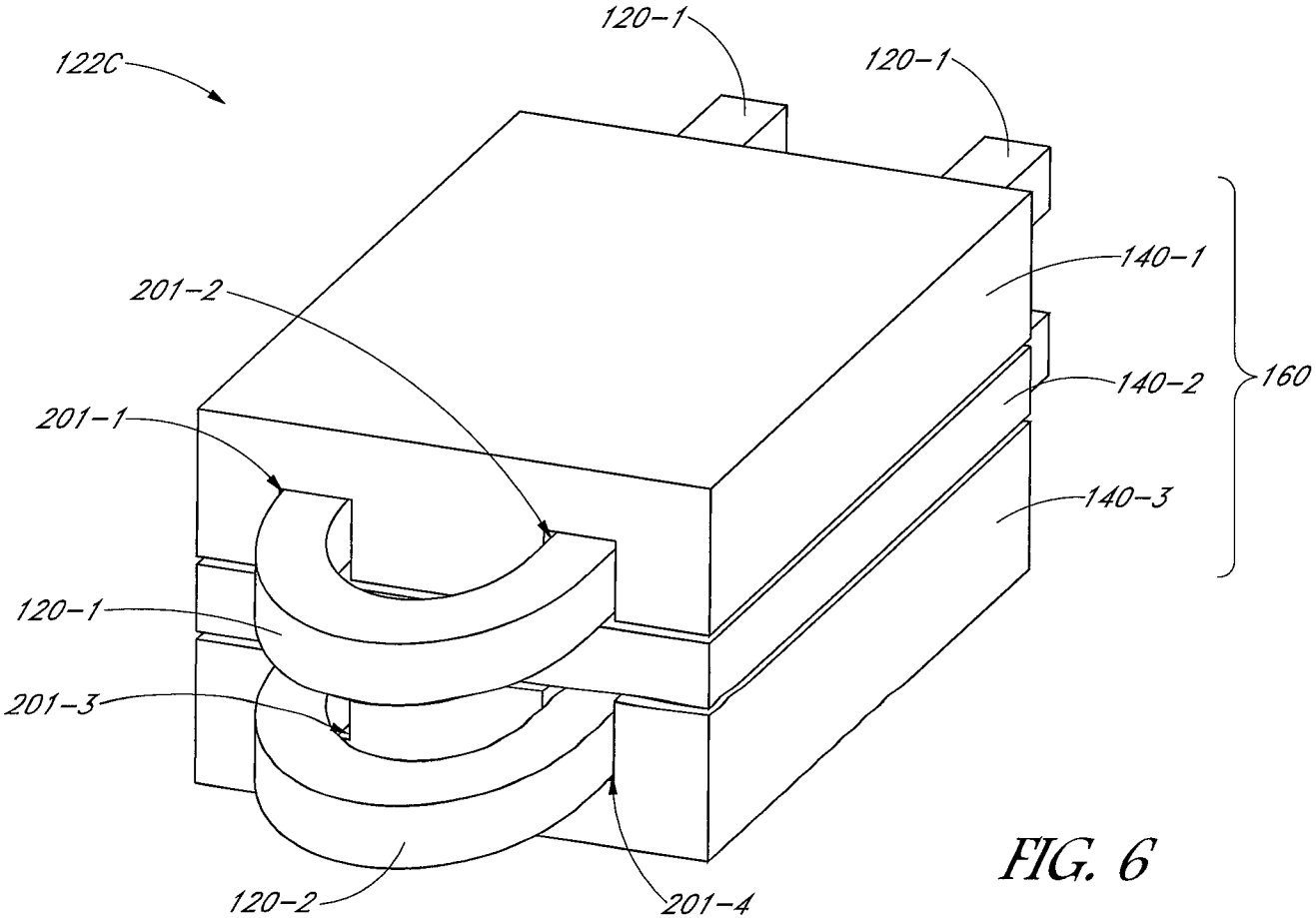
FIG. 6 is a three-dimensional view of an inductor with at least three magnetic core parts in accordance with an embodiment of the present invention.

FIG. 6 is a three-dimensional view of an inductor 122C in accordance with an embodiment of the present invention. The inductor 122C is a coupled inductor comprising a wire 120-1, a wire 120-2, and a multipart magnetic core 160. In the inductor 122C, the multipart magnetic core 160 comprises magnetic core parts 140-1, 140-2, and 140-3. In the inductor 122C, the magnetic core part 140-2 has a planar shape and each of the magnetic core parts 140-1 and 140-3 has an E-shape. The E-shapes are arranged to face each other, with the planar shape interposed between them. The E-shape of the magnetic core part 140-1 has two trenches that when covered by a first planar surface of the magnetic core part 140-2 form the channels 201-1 and 201-2. Similarly, the E-shape of the magnetic core part 140-3 has two trenches that when covered by a second, opposing planar surface of the magnetic core part 140-2 form the channels 201-3 and 201-4. In contrast to the inductor 122A, each wire of the inductor 122C winds through two, separate channels. More particularly, in the inductor 122C, the wire 120-1 winds through the channels 201-1 and 201-2, whereas the wire 120-2 winds through the channels 201-3 and 201-4.

Figure 7:
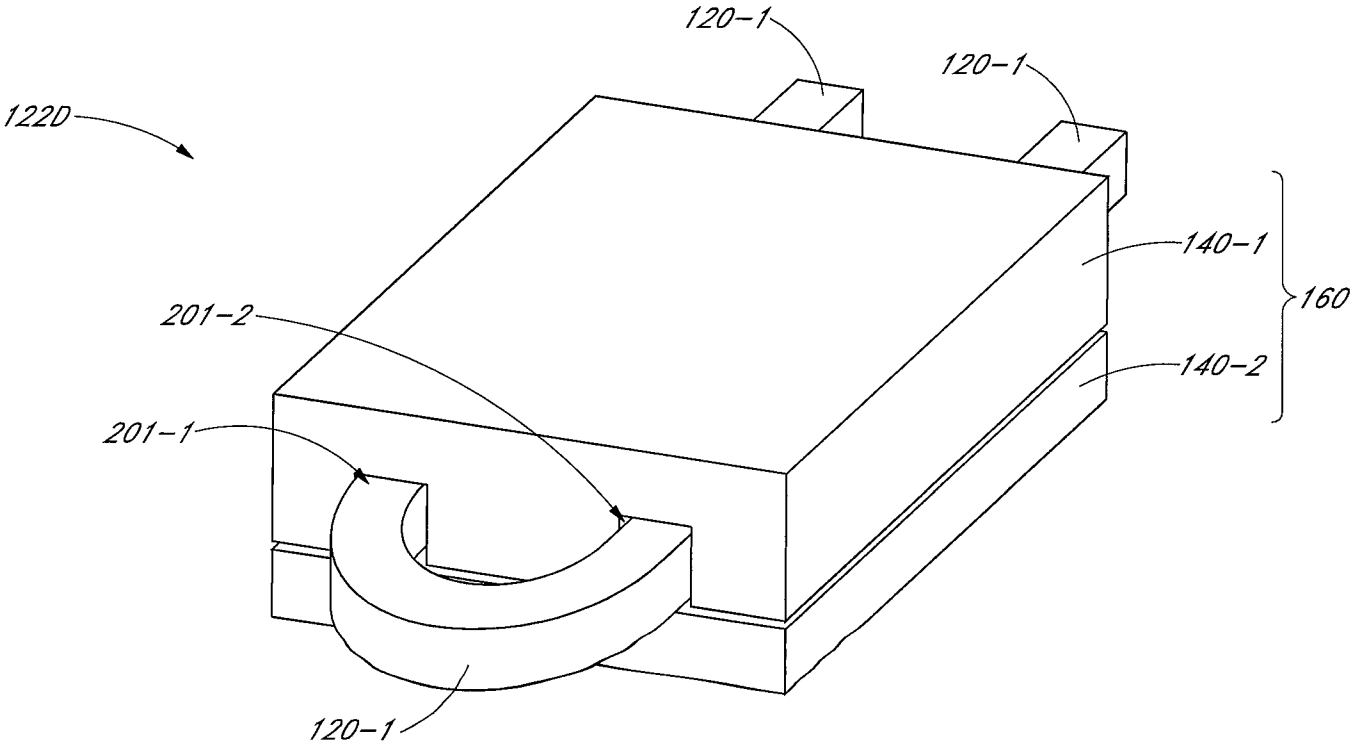
FIG. 7 is a three-dimensional view of another inductor with asymmetrical magnetic core parts in accordance with an embodiment of the present invention.

An inductor may be a single inductor or a coupled inductor. A coupled inductor has two or more wires that go through a multipart magnetic core, whereas a single inductor has a single wire that goes through a multipart magnetic core. A coupled inductor may be converted to a single inductor by removing one or more extraneous wires. For example, as shown in FIG. 7, an inductor 122D is the same as the inductor 122A (e.g., see FIG. 1) except that the inductor 122D has a single wire. In the inductor 122D, the wire 120-1 winds through the channels 201-1 and 201-2 formed by the magnetic core parts 140-1 and 140-2. The inductor 122D is otherwise the same as the inductor 122A.

Figure 8:
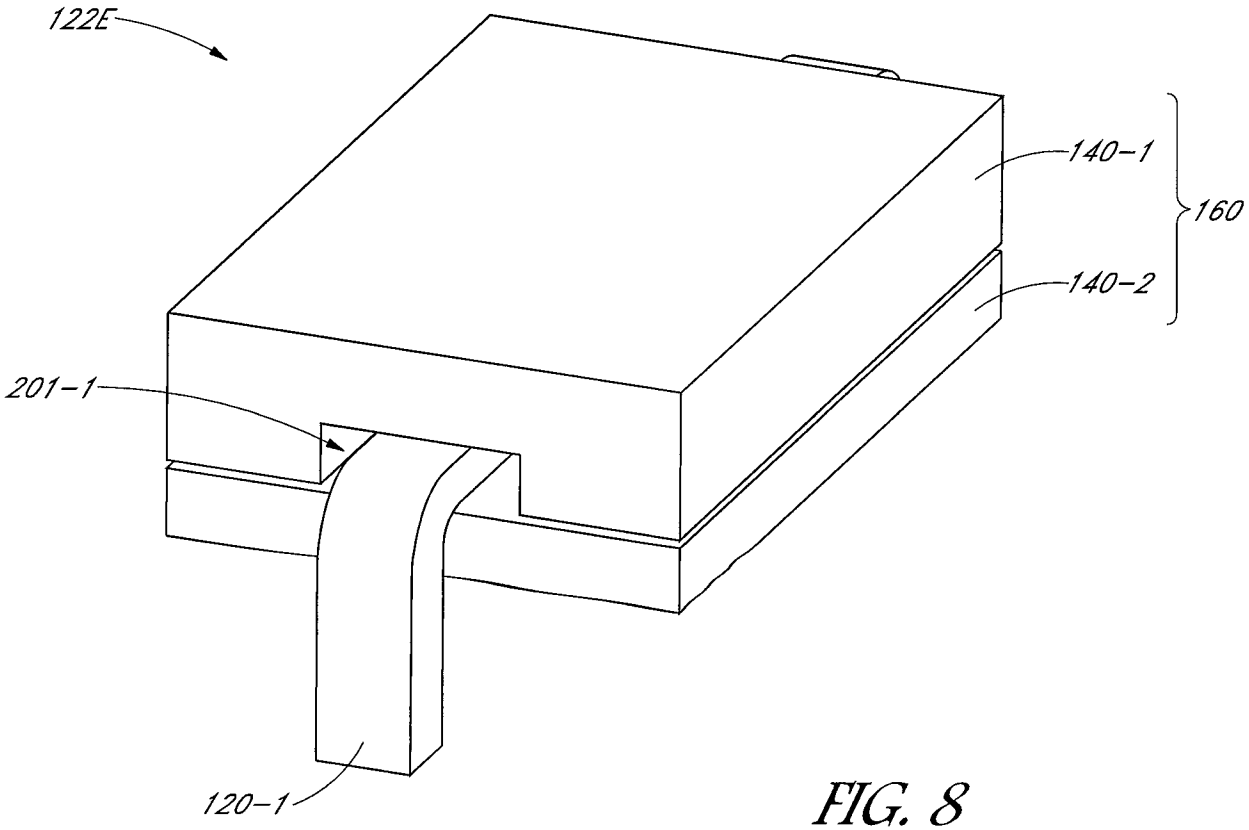
FIG. 8 is a three-dimensional view of an inductor with asymmetrical magnetic core parts and a single channel in accordance with an embodiment of the present invention.

FIG. 8 is a three-dimensional view of an inductor 122E in accordance with an embodiment of the present invention. The inductor 122E is a single inductor that has been adapted from the coupled inductor 122A. The inductor 122E comprises a wire 120-1 and a multipart magnetic core 160. In the inductor 122E, the magnetic core part 140-1 has a U-shape and the magnetic core part 140-2 has a planar shape. The U-shape of the magnetic core part 140-1 has a single trench that when covered by a planar surface of the magnetic core part 140-2 forms the channel 201-1. The inductor 122B is otherwise the same as the inductor 122A.

The inductors 122D, 122E, and other single inductors in the present disclosure may be employed in various electrical circuits. For example, as employed in a single-phase power converter, a first end of the wire 120-1 (e.g., see FIG. 22, end 141) may be electrically connected to a switch node of the power converter and a second end of the wire 120-1 (e.g., see FIG. 22, end 142) may be electrically connected to an output node of the power converter.

The magnetic core parts may have a symmetrical, asymmetrical, or other shape configuration. For example, whereas the magnetic core parts 140-1 and 140-2 are asymmetrical in the inductor 122A, FIG. 9-11 show an inductor 122F with magnetic core parts 140-1 and 140-2 that are symmetrical.

Figure 9:
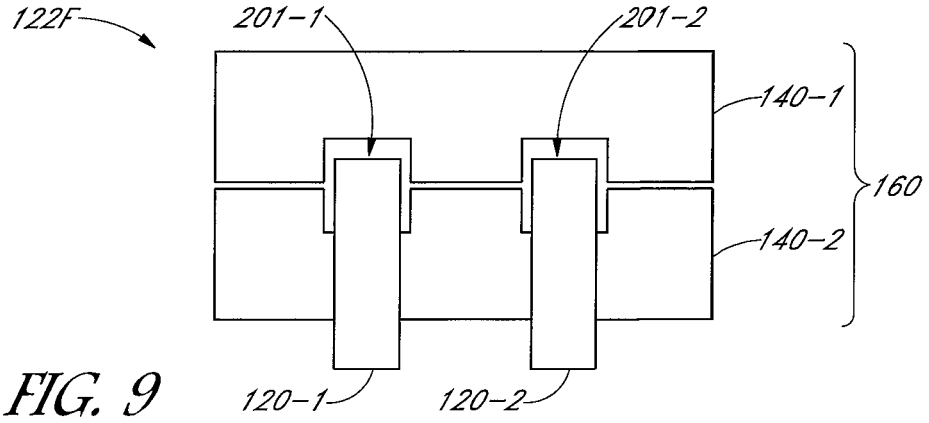
FIGS. 9-11 are various views of an inductor with symmetrical magnetic core parts in accordance with an embodiment of the present invention.

FIG. 9 is a front view of the inductor 122F in accordance with an embodiment of the present invention. The inductor 122F is a coupled inductor comprising a wire 120-1, a wire 120-2, and a multipart magnetic core 160. In the inductor 122F, the multipart magnetic core 160 comprises magnetic core parts 140-1 and 140-2 that are symmetrical in shape. In the inductor 122F, the magnetic core parts 140-1 and 140-2 each has an E-shape with two trenches. A trench of the magnetic core part 140-1 form a channel 201-1 with a trench of the magnetic core part 140-2, and another trench of the magnetic core part 140-1 form a channel 201-2 with another trench of the magnetic core part 140-2. In the inductor 122F, the wire 120-1 winds through the channel 201-1, whereas the wire 120-2 winds through the channel 201-2. The inductor 122F is otherwise the same as the inductor 122A.

Figure 10:
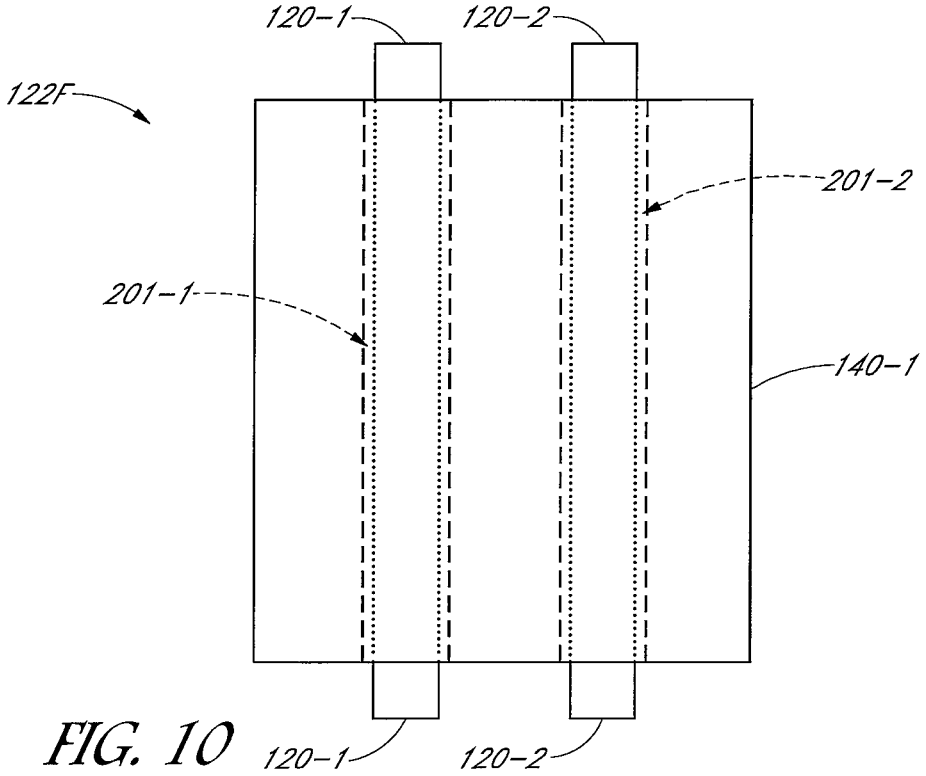
Figure 11:
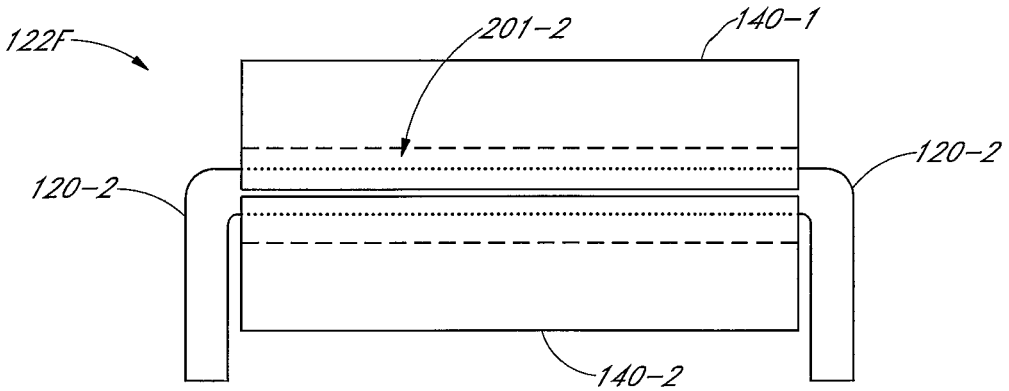

FIGS. 10 and 11 are a top view and a side view, respectively, of the inductor 122F. The labeled features in FIGS. 10 and 11 are the same as those shown in FIGS. 3 and 4, except for the shape of the magnetic core 140-1 and the magnetic core 140-2 as noted above.

Figure 12:
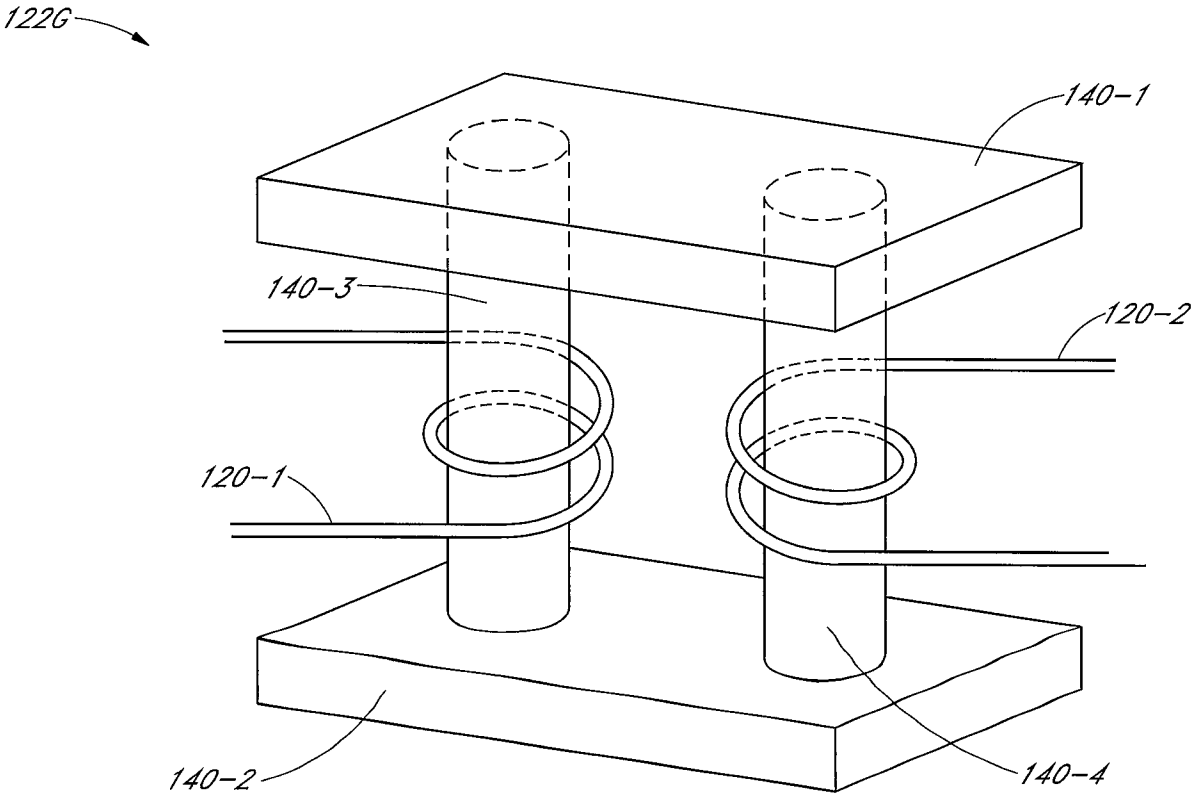
FIG. 12 is a three-dimensional view of an inductor with cylindrical magnetic core parts in accordance with an embodiment of the present invention.

A multipart magnetic core may have rectangular and/or non-rectangular (e.g., cylindrical or toroidal) magnetic core parts, as now described with FIG. 12.

FIG. 12 is a three-dimensional view of an inductor 122G in accordance with an embodiment of the present invention. The inductor 122G is a coupled inductor comprising a wire 120-1 and a wire 120-2. In the inductor 122G, the multipart magnetic core comprises magnetic core parts 140-1, 140-2, 140-3, and 140-4. In the inductor 122G, each of the magnetic core parts 140-1 and 140-2 has a planar shape, and each of the magnetic core parts 140-3 and 140-4 has a cylindrical shape. The magnetic core parts 140-3 and 140-4 serve as posts that are capped by the magnetic core parts 140-1 and 140-2 at each end. In the inductor 122G, the wire 120-1 is wound around the magnetic core part 140-3 and the wire 120-2 is wound around the genetic core part 140-4. Generally, a wire may be wound one or more times around a corresponding magnetic core part.

In the inductor 122G, the magnetic core parts 140-1, 140-2, 140-3, and 140-4 are depicted as physically separate parts that are physically and magnetically coupled together to form a multipart magnetic core. Generally, two or more of the magnetic core parts may be fabricated as a single magnetic core part. For example, the magnetic core parts 140-1 and 140-3 may be fabricated as a single magnetic core part and, similarly, the magnetic core parts 140-2 and 140-4 may be fabricated as another single magnetic core part. The single magnetic core parts may be joined together to form the multipart magnetic core of the inductor 122G.

Figure 13:
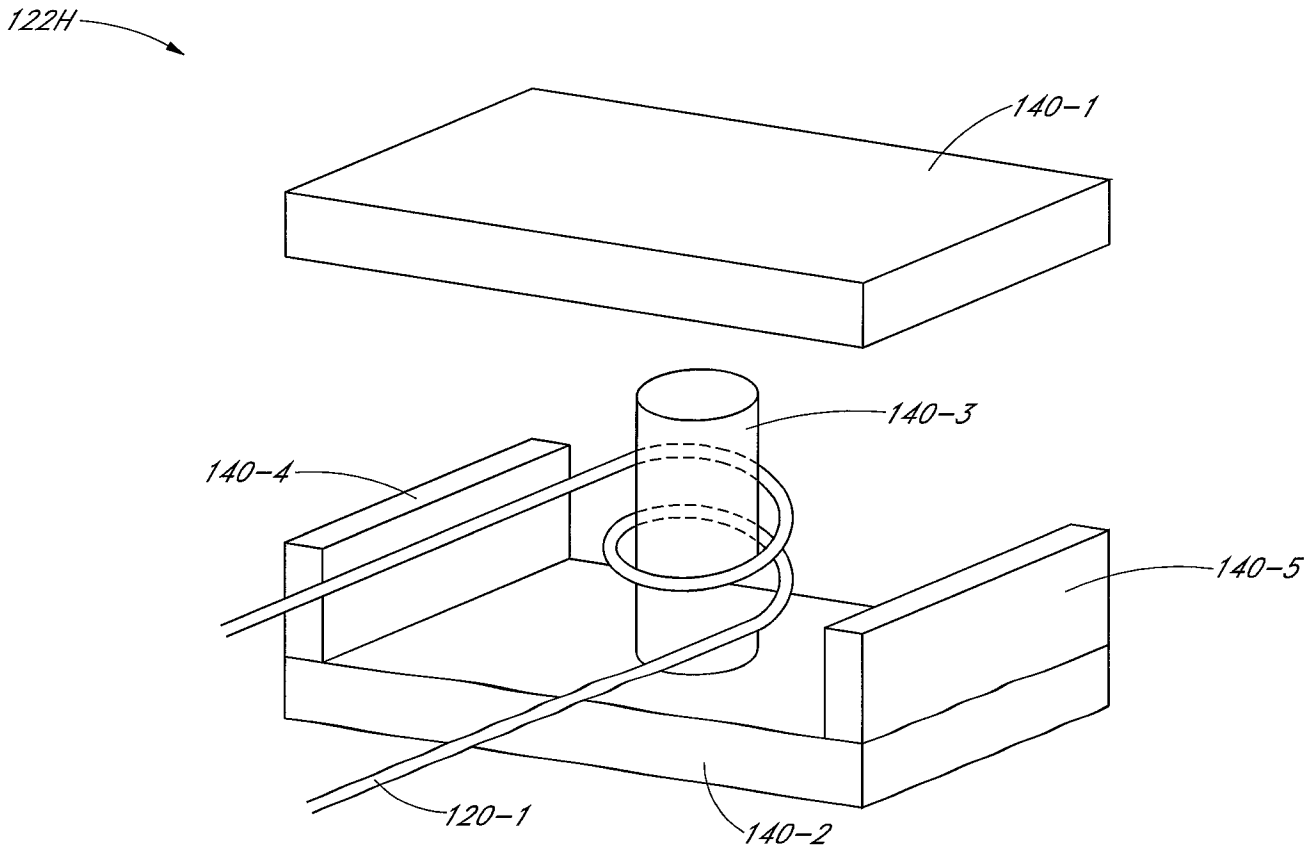
FIG. 13 is a three-dimensional view of another inductor with cylindrical magnetic core part in accordance with an embodiment of the present invention.

FIG. 13 is a three-dimensional view of an inductor 122H in accordance with an embodiment of the present invention. The inductor 122H is a single inductor comprising a wire 120-1 and a multipart magnetic core. In the inductor 122H, the multipart magnetic core comprises magnetic core parts 140-1, 140-2, 140-3, 140-4, and 140-5. In the inductor 122H, each of the magnetic core parts 140-1, 140-2, 140-4, and 140-5 has a planar shape and the magnetic core part 140-3 has a cylindrical shape. The magnetic core part 140-3 serves as a post that is capped at both ends by the magnetic core parts 140-1 and 140-2. In the inductor 122H, the wire 120-1 may be wound one or more times around the magnetic core part 140-3. In the inductor 122H, the magnetic core parts 140-4 and 140-5 serve as blocks that are interposed between the magnetic core parts 140-1 and 14-2 to provide structural support. The magnetic core parts 140-1, 140-2, 140-3, and 140-4 are disposed to form a box with an open front and an open back, through which the wire 120-1 may be wound around the magnetic core part 140-3.

Figure 14:
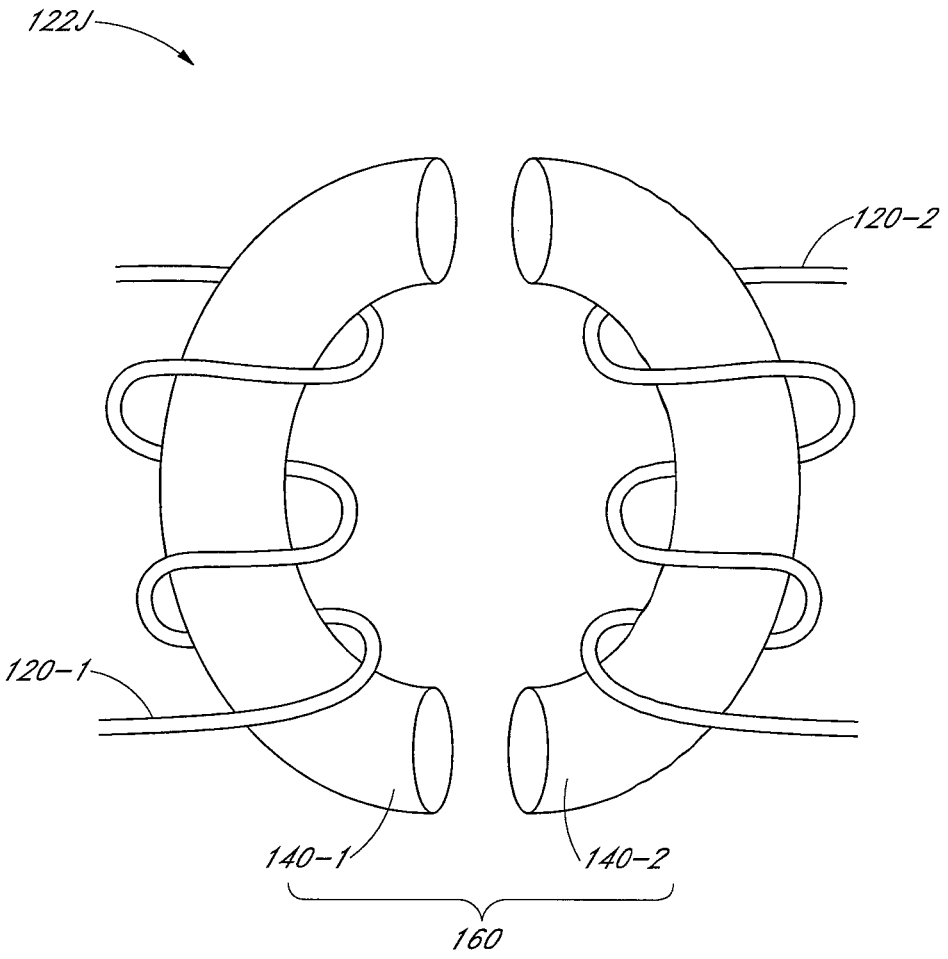
FIG. 14 is a three-dimensional view of an inductor with toroidal magnetic core parts in accordance with an embodiment of the present invention.

FIG. 14 is a three-dimensional view of an inductor 122J in accordance with an embodiment of the present invention. The inductor 122J is a coupled inductor comprising a wire 120-1, a wire 120-2, and a multipart magnetic core 160. In the inductor 122J, the multipart magnetic core 160 has a toroidal shape that is formed by the magnetic core parts 140-1 and 140-2. More particularly, the magnetic core parts 140-1 and 140-2 each has a half-toroidal shape; joining the magnetic core parts 140-1 and 140-2 together form the toroidal shape of the multipart magnetic core 160. In the inductor 122J, the wire 120-1 is wound one or more times around the magnetic core part 140-1 and the wire 120-2 is wound one or more times around the magnetic core part 140-2. A single inductor version of the inductor 122J may be fabricated by simply omitting either the wire 120-1 or wire 120-2.

An inductance profile indicates an inductance of an inductor for a given current flowing through a wire of the inductor. In light of the present disclosure, it can be appreciated that the material and geometry (e.g., shape, size, and structural arrangement) of the magnetic core parts may be selected or designed to meet the inductance and current requirements of a target inductance profile. Other parameters of the inductor, such as wire material, wire gauge, wire winding configuration, medium between magnetic core parts, etc., may also be selected or designed to satisfy the target inductance profile. An electrical component vendor is thus able to commercially manufacture an inductor that meets a target inductance profile by combining the effects of different inductor parameters.

Figure 15:
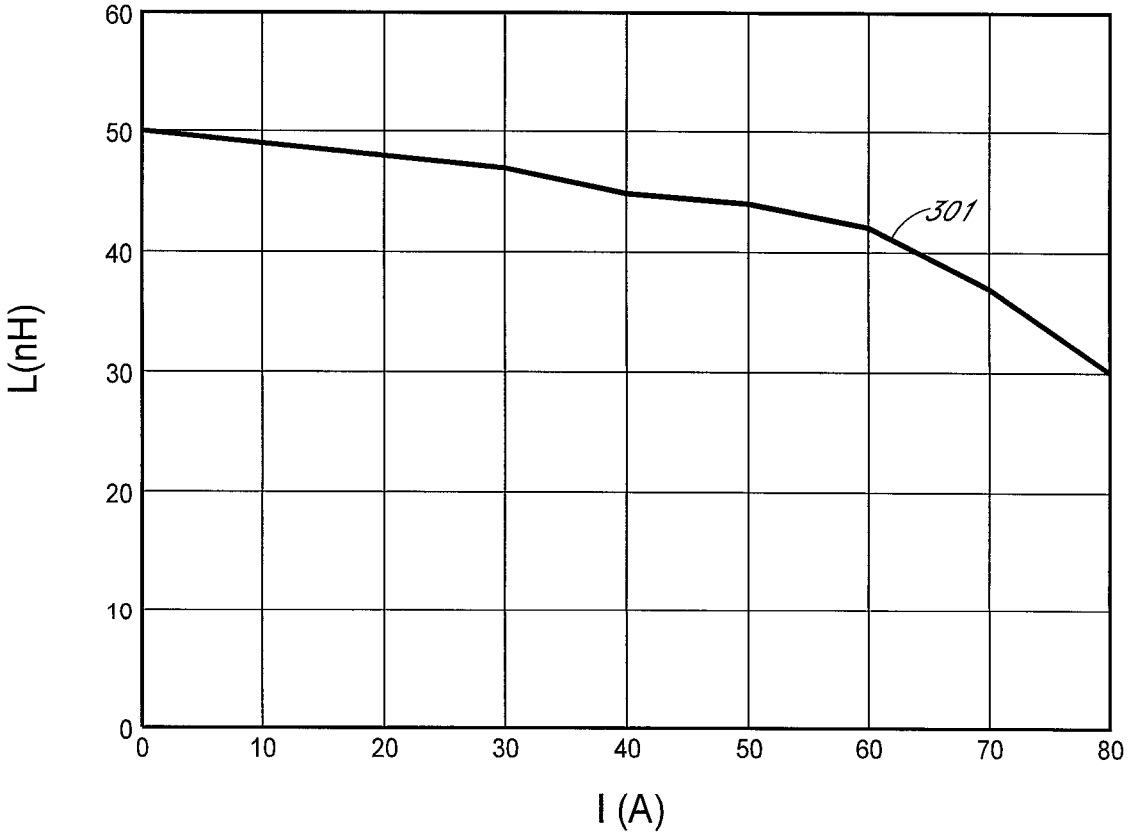
FIG. 15 shows a plot of an inductance profile of an inductor in accordance with an embodiment of the present invention.

FIG. 15 shows a plot 301 of an inductance profile of an inductor 122 (i.e., 122A, 122B, 122C, . . . ) in accordance with an embodiment of the present invention. In the example of FIG. 15, the vertical axis indicates an inductance L in nanoHenry (nH) and the horizontal axis indicates current I in amp (A). As can be seen from the plot 301, the inductor 122, for each wire 120 (i.e., 120-1, 120-2, . . . ), has an inductance of at least 40 nH for currents that are greater than 1 A and less than 60 A, and an inductance of at least 20 nH for currents of at least 60 A. The inductance profile of the inductor 122 advantageously allows for a good balance between efficiency and transient response.

Figure 16:
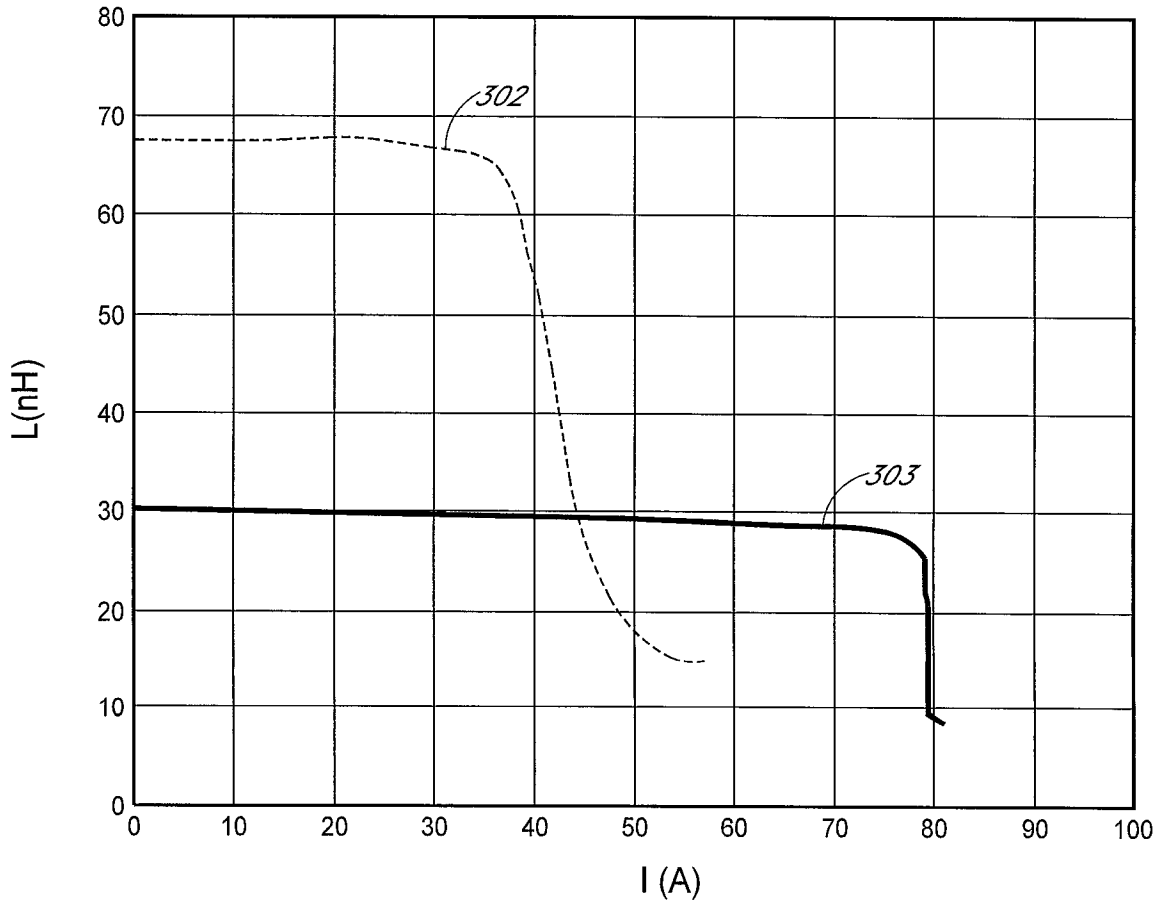
FIG. 16 shows plots of inductance profiles of inductors that have one-piece magnetic cores made of ferrites.

FIG. 16 shows plots of inductance profiles of inductors that have magnetic cores made of ferrites. In the example of FIG. 16, the vertical axis indicates an inductance L in nanoHenry (nH) and the horizontal axis indicates current I in amp (A). In the example of FIG. 16, a plot 302 of inductance profile is of an example inductor with a one-piece (as opposed to multipart) magnetic core made of ferrite, and a plot 303 of an inductance profile is of another example inductor with a one-piece magnetic core that is also made of ferrite. Inductors with ferrite magnetic cores typically have a steep saturation slope. When configured to provide high inductance, a ferrite magnetic core results in low saturation current as indicated by the plot 302. When configured to provide low inductance, a ferrite magnetic core results in high saturation current as indicated by the plot 303.

In the example of FIG. 16, the difference between the inductance profiles may be attributed to different geometries and/or percent composition of the ferrite magnetic cores. Different magnetic core parts that are made of ferrite (or other magnetic material) may be configured to have different geometries and/or percent composition to achieve a combined effect that meets the inductance-current requirements of a target inductance profile. That is, a multipart magnetic core may comprise magnetic core parts that are made of the same material but have different geometries and/or percent composition to meet the inductance-current requirement of a target inductance profile. For example, a first magnetic core part may be configured to have the plot 302 of inductance profile and a second magnetic core part may be configured to have the plot 303 of inductance profile, such that the resulting multipart magnetic core allows the inductor to have high inductance at low currents and low inductance at high currents. High inductance at low currents allows for better efficiency, while low inductance at high currents allows for better transient response.

Figure 17:
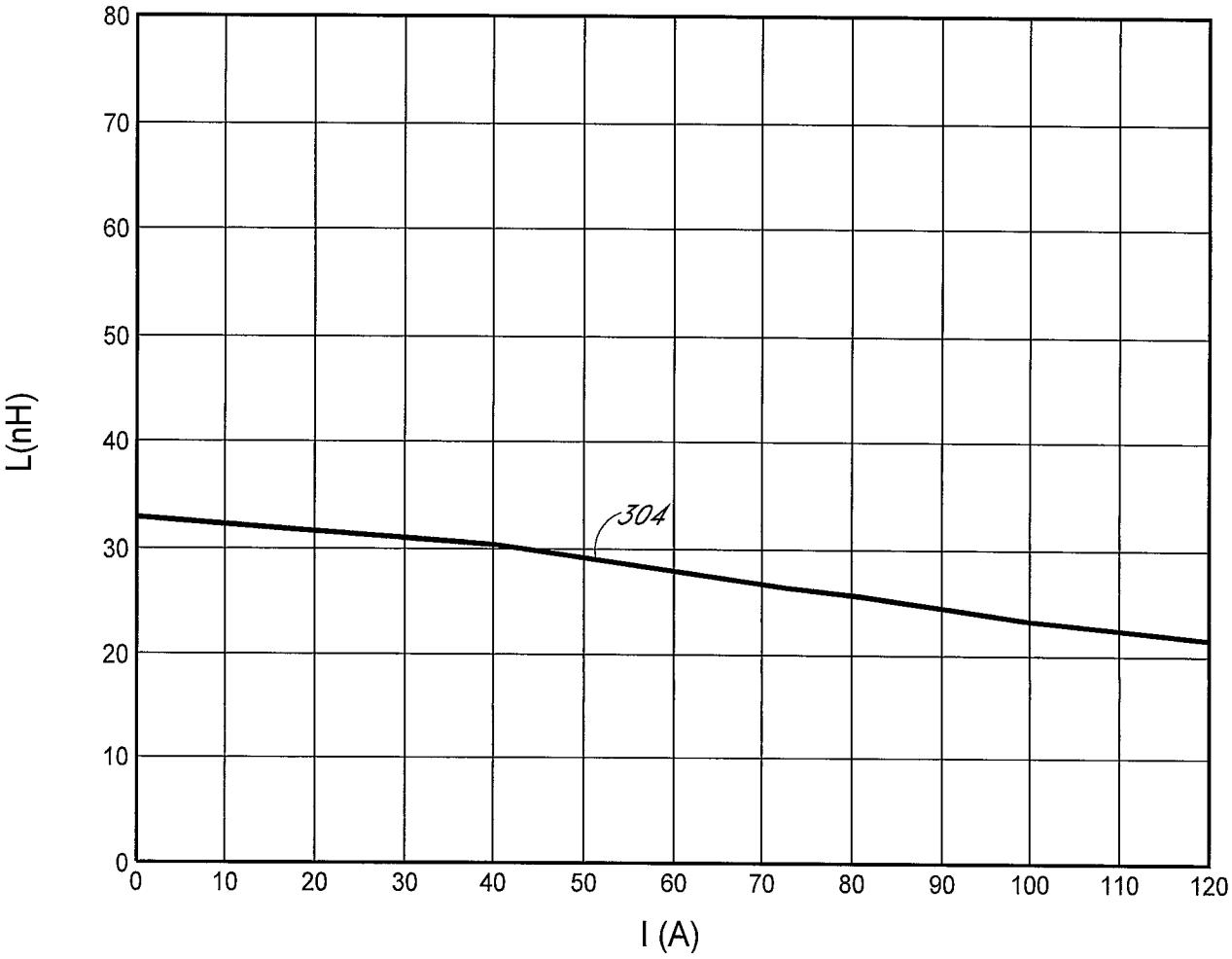
FIG. 17 shows a plot of inductance profile of an inductor that has a one-piece magnetic core made of iron powder.

FIG. 17 shows a plot 304 of inductance profile of an inductor that has a one-piece magnetic core made of iron powder. In the example of FIG. 17, the vertical axis indicates an inductance L in nanoHenry (nH) and the horizontal axis indicates current I in amp (A). Inductors that have iron powder magnetic cores typically have low inductance and high saturation current with shallow saturation slope as indicated by the plot 304. As magnetic core materials, ferrite has steeper saturation slope and higher permeability than iron powder.

Figure 18:
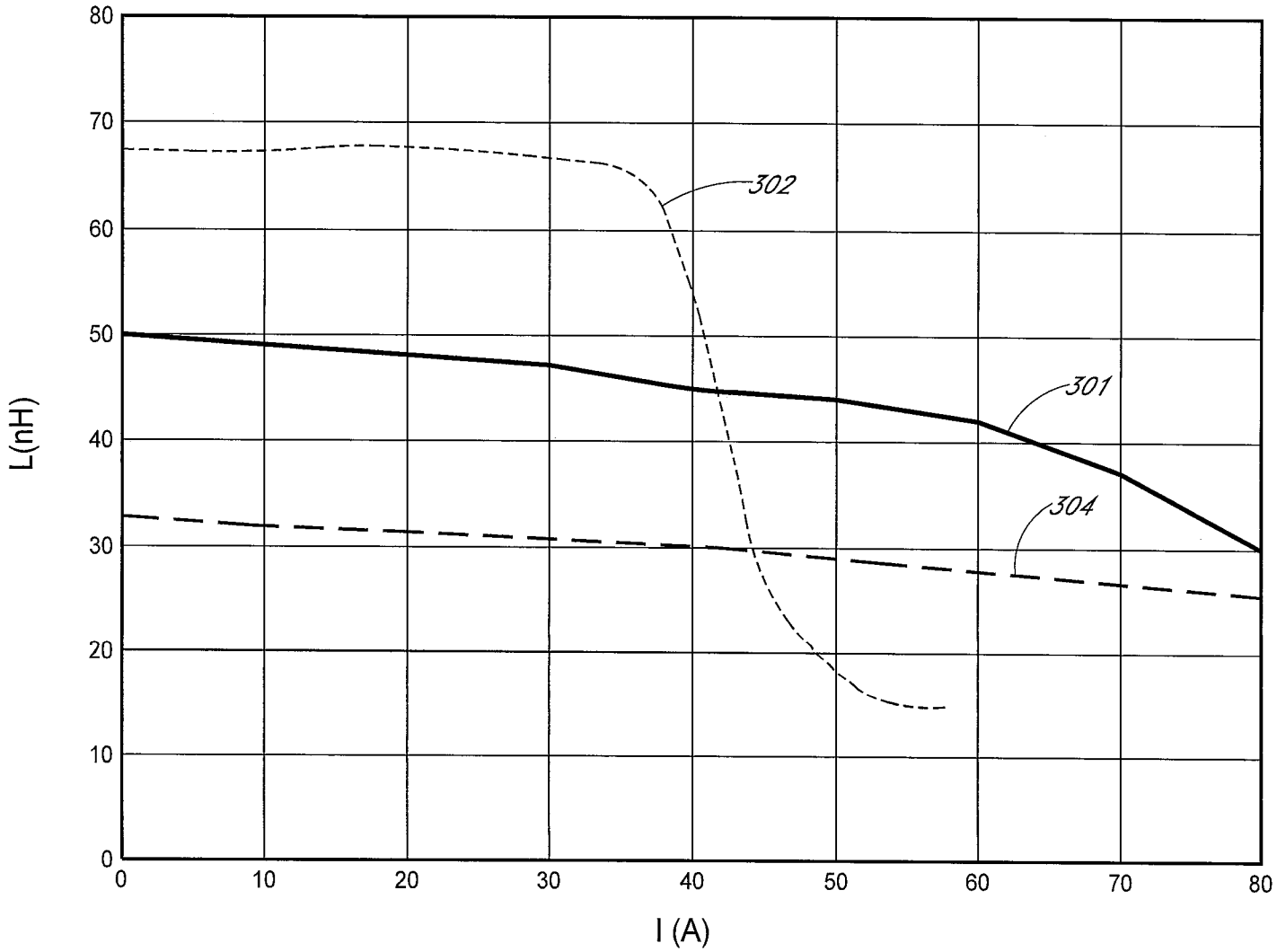
FIG. 18 shows the plot of FIG. 15 together with the plots of FIGS. 16 and 17.

The inductance-current requirements of a target inductance profile may also be met by having magnetic core parts that have different materials, as now described with FIG. 18.

FIG. 18 shows the plot 301 of FIG. 15 together with the plot 302 of FIG. 16 and the plot 304 of FIG. 17. In the example of FIG. 18, the vertical axis indicates an inductance L in nanoHenry (nH) and the horizontal axis indicates current I in amp (A). As previously noted, the plot 302 of inductance profile is that of an inductor with a one-piece magnetic core made of ferrite and the plot 304 of inductance profile is that of an inductor with a one-piece magnetic core made of iron powder. An inductor 122 may be configured to have the plot 302 of inductance profile by having a multipart magnetic core comprising one or more magnetic core parts made of ferrite and one or more magnetic core parts made of iron powder. For example, in the inductor 122A of FIG. 1, the magnetic core part 140-1 may be made of iron powder, while the magnetic core part 140-2 may be made of ferrite. The combined effect of the different magnetic materials may be visualized by combining the plot 302 with the plot 304. The combined effect allows the inductor 122 to have high inductance at low current levels (as in the plot 302) and low inductance at high current levels (as in the plot 304). The geometries of the magnetic core parts may be configured as needed to make adjustments to the combined effect.

Figure 19:
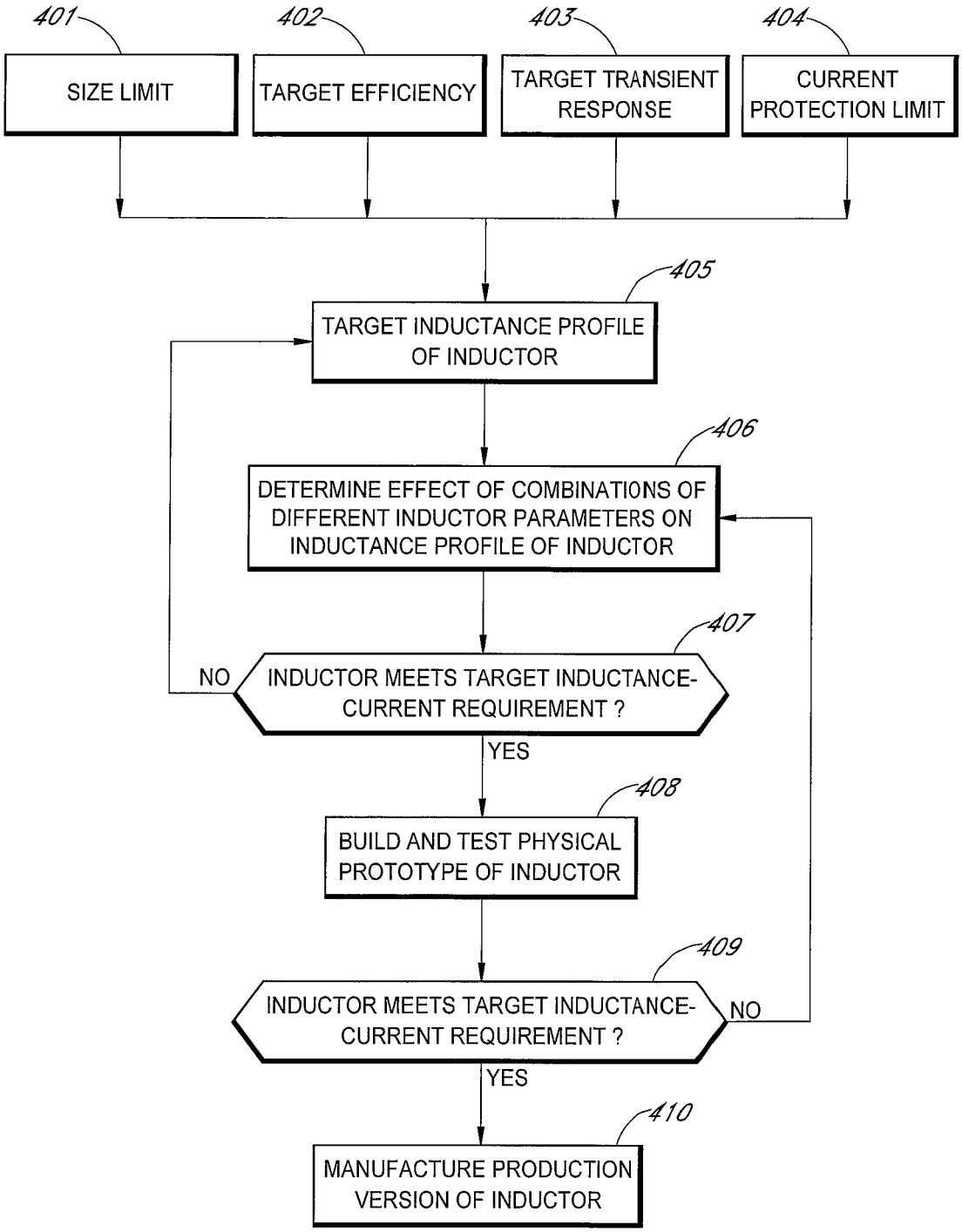
FIG. 19 is a flow diagram of a method of creating an inductor in accordance with an embodiment of the present invention.

FIG. 19 is a flow diagram of a method of creating an inductor 122 in accordance with an embodiment of the present invention. In the example of FIG. 19, the method receives as inputs a size limit (block 401), a target efficiency (block 402), a target transient response (block 403), and a current protection limit (block 404).

The size limit dictates the maximum available volume and/or shape of the multipart magnetic core of the inductor 122. The size limit may have to meet size restrictions of an application, such as available printed circuit board (PCB) area, proximity to surrounding structures, etc.

The target efficiency is the desired energy efficiency of the inductor 122. The target efficiency may be specified as inductance below a predetermined current level. For example, the target efficiency may be the inductance of the inductor at or below a thermal design current (TDC). The target efficiency dictates the inductance of the inductor at low currents. The higher the inductance at low currents, the more efficient the inductor 122 and corresponding circuit.

The target transient response is the desired transient response of the inductor 122. The target transient response dictates the inductance at medium to high current levels. The lower the inductance at medium to high currents, the faster the transient response of the inductor 122.

The current protection limit is the maximum current that is allowed to flow through the inductor 122 or corresponding circuit (e.g., power converter). The current protection limit dictates the minimum inductance at a peak current level.

A target inductance profile of the inductor 122 may be created given the size limit, target efficiency, target transient response, and current protection limit as inputs (block 405). As a particular example, FIG. 20 shows the plot 301 of the inductance profile of an inductor 122 with annotations that explain the aforementioned inputs.

Figure 20:
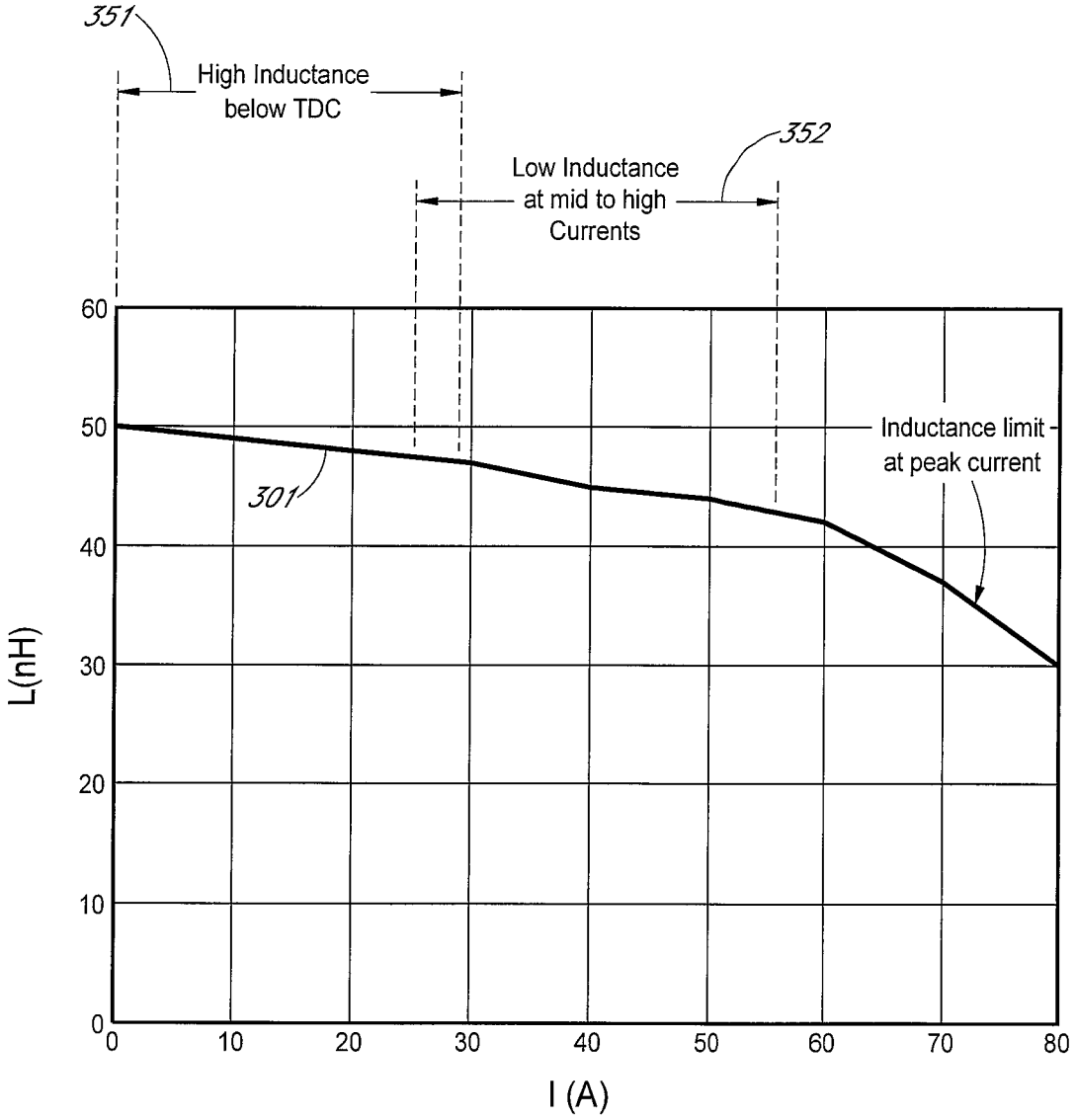
FIG. 20 shows the plot of FIG. 15 with annotations that illustrate the method of FIG. 19.

In the example of FIG. 20 the vertical axis indicates an inductance L in nanoHenry (nH) and the horizontal axis indicates current I in amp (A). In the example of FIG. 20, the size limit is a rectangular volume of 8×9×3 mm, the target efficiency is specified as an inductance range below TDC (see FIG. 20, 351), the target transient response is specified as an inductance range between medium to high currents (see FIG. 20, 352), and the current protection limit is specified as a minimum inductance at peak current.

Continuing the method of FIG. 19, the effect of combinations of different inductor parameters on the inductance profile of the inductor is determined (block 406) by static analysis (e.g., manual calculation), using a suitable simulation software, or other suitable evaluation technique. For example, the inductor 122A of FIG. 1 may be configured to have a magnetic core part 140-1 made of iron powder and a magnetic core part 140-2 made of ferrite. A simulation may be performed to check if that configuration allows the inductor 122A to meet the inductance-current requirement of the target inductance profile. Other combinations of inductor parameters that may be checked for conformance with the target inductance profile include using the same material for magnetic core parts of different geometries, using the same material but with different percent compositions for magnetic core parts, etc.

The target inductance profile may be adjusted when the inductor cannot meet the inductance-current requirement of the target inductance profile given available combinations of inductor parameters (block 407 to block 405).

Once the combination of inductor parameters that meet the inductance-current requirement of the target inductance profile has been determined, a prototype of the inductor may be fabricated and tested (block 407 to block 408). The combination of inductor parameters is reevaluated when the prototype of the inductor does not meet the inductance-current requirement of the target inductance profile (block 409 to block 406). Otherwise, when the prototype of the inductor meets the inductance-current requirement of the target inductance profile, production versions of the inductor may be manufactured (block 409 to block 410).

As can be appreciated, an inductor 122 may be employed in various electrical circuits including power converters, such as DC-DC converters, AC-DC converters, inverters, etc.

Figure 21:
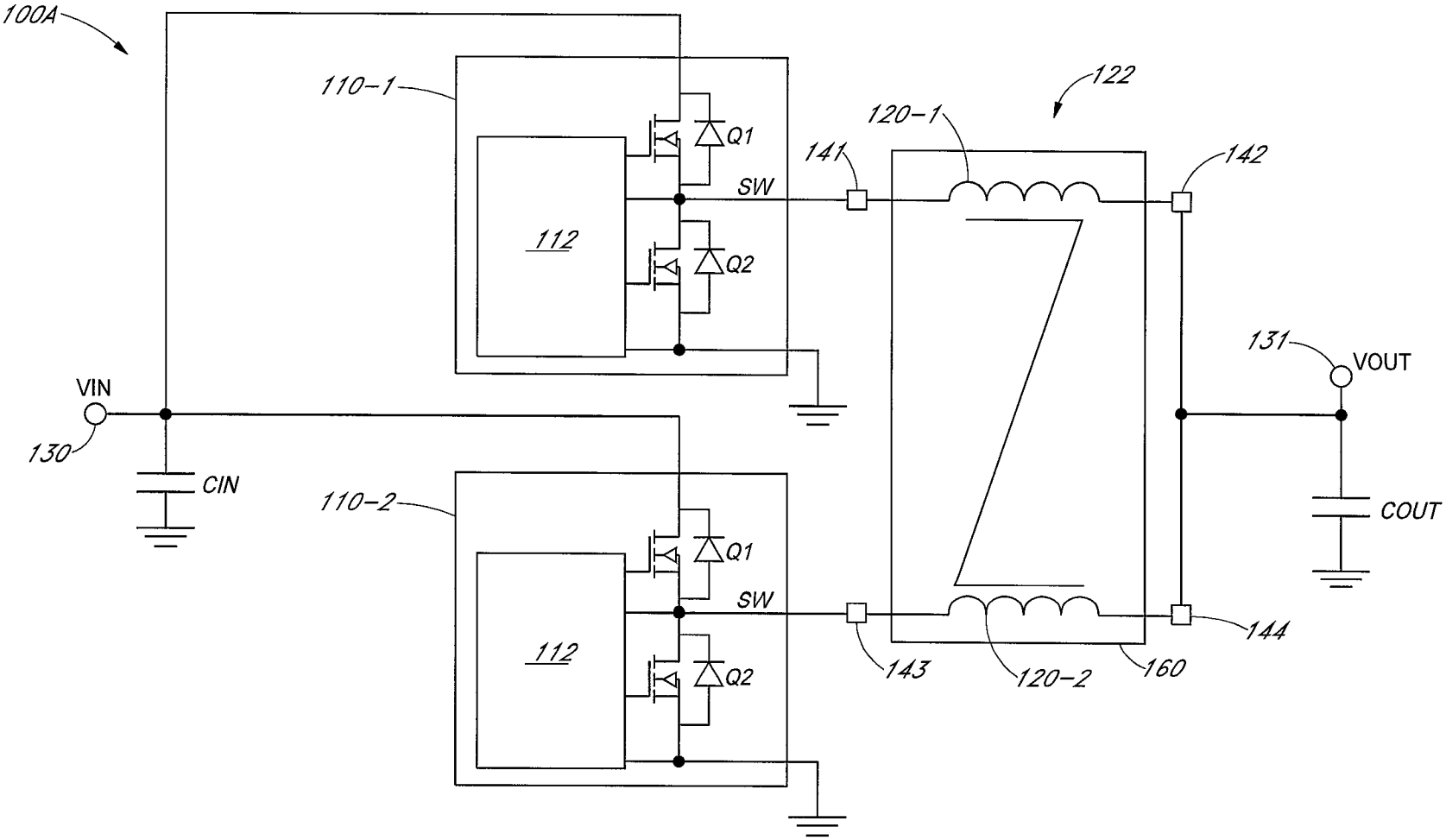
FIG. 21 is a schematic diagram of a multiphase power converter in accordance with an embodiment of the present invention.

FIG. 21 is a schematic diagram of a multiphase power converter 100A in accordance with an embodiment of the present invention. The power converter 100A receives an input voltage VIN at an input node 130 and generates an output voltage VOUT at an output node 131. In the example of FIG. 21, the input voltage VIN is coupled to a capacitor CIN, and the output voltage VOUT is developed across an output capacitor COUT. The power converter 100A may include a plurality of power stage circuits 110 (i.e., 110-1, 110-2, . . . ), one for each output phase. Two power stage circuits 110 are shown in the example of FIG. 21 for illustration purposes. The power converter 100A may have two or more power stage circuits 110.

In the example of FIG. 21, a power stage circuit 110 includes a control circuit 112, which controls switching of a high-side switch Q1 and a low-side switch Q2 to generate an output phase at a switch node SW. The switches Q1 and Q2 may be a metal-oxide semiconductor field effect transistor (MOSFET) or some other type of transistor. The control circuit 112 may drive the switches Q1 and Q2 by pulse-code modulation (PCM) or some other control scheme. As can be appreciated, the particulars of the control circuit 112 will vary depending on the topology and type of the power converter 100A.

In the example of FIG. 21, an inductor 122 is a coupled inductor that couples the output phases of the power stage circuits 110 to the output node 131. In the example of FIG. 21, the inductor 122 may be the inductor 122A (see FIG. 1), the inductor 122B (see FIG. 5), the inductor 122C (see FIG. 6), the inductor 122F (see FIG. 9), the inductor 122G (see FIG. 12), or the inductor 122J (see FIG. 14).

The inductor 122 comprises a multipart magnetic core 160 and a plurality of wires 120 (i.e., 120-1, 120-2 . . . ) as previously described. In the example of FIG. 21, the wire 120-1 has an end 141 that is coupled to the switch node SW of the power stage circuit 110-1 and an opposing end 142 that is coupled to the output node 131. Similarly, the wire 120-2 has an end 143 that is coupled to the switch node SW of the power stage circuit 110-2 and an opposing end 144 that is coupled to the output node 131.

Figure 22:
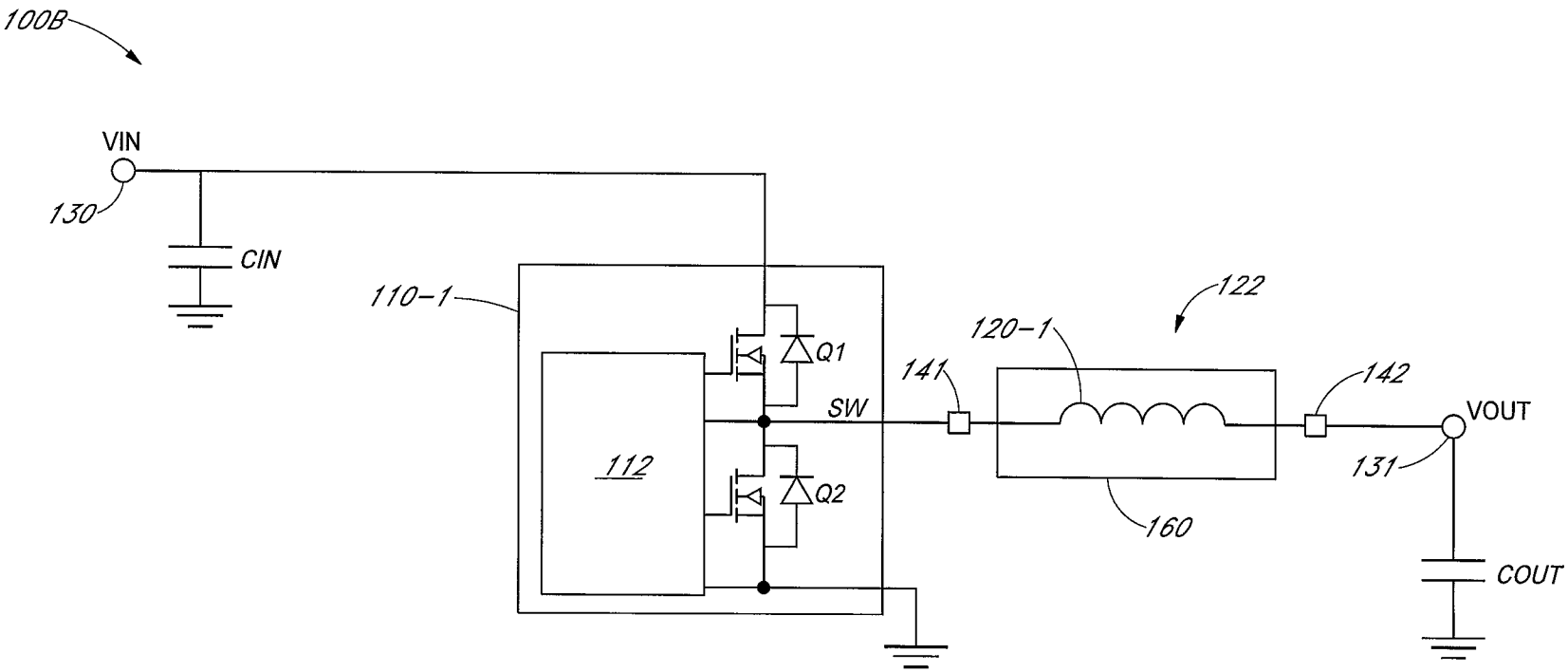
FIG. 22 is a schematic diagram of a single phase power converter in accordance with an embodiment of the present invention.

FIG. 22 is a schematic diagram of a single-phase power converter 100B in accordance with an embodiment of the present invention. The power converter 100B is the same as the power converter 100A, except that the power converter 100B has a single output phase. Accordingly, the power converter 1008 includes a single (instead of a coupled) inductor 122. In the example of FIG. 22, the inductor 122 may be the inductor 122D (see FIG. 7), the inductor 122E (see FIG. 8), the inductor 122H (see FIG. 13), or the inductor 122J without the wire 120-2 (see FIG. 14).

Inductors with multipart magnetic cores and method of creating same have been disclosed. While specific embodiments of the present invention have been provided, it is to be understood that these embodiments are for illustration purposes and not limiting. Many additional embodiments will be apparent to persons of ordinary skill in the art reading this disclosure.

What is claimed is:

1. An inductor comprising:

a first magnetic core part of a plurality of magnetic core parts of the inductor, the first magnetic core part comprising a first magnetic material;

a second magnetic core part of the plurality of magnetic core parts, the second magnetic core part comprising a second magnetic material that is different from the first magnetic material, the second magnetic core part being adjacent and magnetically coupled to the first magnetic core part; and a first wiring that is wound on at least one of the first magnetic core part and the second magnetic core part, wherein the first magnetic material has a steeper saturation slope and higher permeability than the second magnetic material, wherein the inductor provides an inductance of at least 40 nH for currents between 1 A and 60 A, and at least 20 nH for currents of at least 60 A.

2. The inductor of claim 1, wherein the first magnetic material comprises iron powder and the second magnetic material comprises a ferrite.

3. The inductor of claim 1, wherein the first magnetic core part and the second magnetic core part are asymmetrical in shape.

4. The inductor of claim 1, further comprising:

a second wiring that is wound on at least one of the first magnetic core part and the second magnetic core part.

5. The inductor of claim 4, wherein the first magnetic core part and the second magnetic core part form a first channel and a second channel, the first wiring goes through the first channel, and the second wiring goes through the second channel.

6. The inductor of claim 4, wherein the first magnetic core part has first and second trenches, the second magnetic core part has a planar shape, the first wire winds through a first channel formed by the first trench and a surface of the second magnetic core part, and the second wire winds through a second channel formed by the second trench and the surface of the second magnetic core part.

7. The inductor of claim 4, wherein each of the first and second wires goes through the multipart magnetic core only once.

8. An inductor comprising:

a multipart magnetic core comprising a first magnetic core part and a second magnetic core part, the first magnetic core part comprising a first magnetic material, the second magnetic core part comprising a second magnetic material that is different from the first magnetic material;

a first wiring that goes through a first channel formed by the first and second magnetic core parts; and a second wiring that goes through a second channel formed by the first and second magnetic core parts, wherein the inductor provides an inductance of at least 40 nH for currents between 1 A and 60 A, and at least 20 nH for currents of at least 60 A.

9. The inductor of claim 8, wherein the first magnetic material has a steeper saturation slope and higher permeability than the second magnetic material.

10. The inductor of claim 8, wherein the first magnetic material comprises iron powder and the second magnetic material comprises a ferrite.

11. The inductor of claim 8, wherein the first magnetic core part and the second magnetic core part have an asymmetrical shape.

12. An inductor comprising:

a first magnetic core part comprising a first magnetic material;

a second magnetic core part that is adjacent and magnetically coupled to the first magnetic core part, the second magnetic core part comprising a second magnetic material that is different from the first magnetic material; and a first wire that is wound on at least one of the first magnetic core part and the second magnetic core part, wherein the inductor provides an inductance of at least 40 nH for currents between 1 A and 60 A, and at least 20 nH for currents of at least 60 A.

13. The inductor of claim 12, wherein the first magnetic material has a steeper saturation slope and higher permeability than the second magnetic material.

14. The inductor of claim 12, wherein the first magnetic core part and the second magnetic core part have an asymmetrical shape.

* * * * *